US007992715B2

(12) United States Patent
Kwon

(10) Patent No.: US 7,992,715 B2
(45) Date of Patent: Aug. 9, 2011

(54) DEVELOPING AGENT CONTAINER PACKAGE UNIT, PACKING RECEPTACLE FOR DEVELOPING AGENT CONTAINER, AND PACKING METHOD OF DEVELOPING AGENT CONTAINER

(75) Inventor: Se-il Kwon, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 12 days.

(21) Appl. No.: 12/044,214

(22) Filed: Mar. 7, 2008

(65) Prior Publication Data

US 2009/0074472 A1 Mar. 19, 2009

(30) Foreign Application Priority Data

Sep. 13, 2007 (KR) ..... 10-2007-0093344

(51) Int. Cl.
*B65D 81/02* (2006.01)

(52) U.S. Cl. ..... 206/588; 206/523; 206/576; 206/320

(58) Field of Classification Search ..... 206/485, 206/512–594, 320
See application file for complete search history.

(56) References Cited

U.S. PATENT DOCUMENTS

| | | | | |
|---|---|---|---|---|
| 4,287,990 | A * | 9/1981 | Kurick | 206/448 |
| 5,232,095 | A * | 8/1993 | Childers et al. | 206/583 |
| 6,241,090 | B1 * | 6/2001 | Kaplinsky | 206/315.11 |
| 6,398,026 | B1 * | 6/2002 | Parsons | 206/349 |
| 6,412,635 | B1 * | 7/2002 | Lu | 206/523 |
| 6,431,362 | B1 * | 8/2002 | Araki et al. | 206/588 |
| 7,198,155 | B2 * | 4/2007 | Otsuka et al. | 206/576 |
| 7,278,249 | B2 * | 10/2007 | Kari | 53/397 |

* cited by examiner

*Primary Examiner* — Mickey Yu
*Assistant Examiner* — Chun Cheung
(74) *Attorney, Agent, or Firm* — Stanzione & Kim, LLP

(57) ABSTRACT

A developing agent container package unit includes a packing case, a developing agent container received inside the packing case and storing developing agent, and a supporting member to support the developing agent container so that the developing agent container is inclined with respect to one side surface of the packing case.

35 Claims, 9 Drawing Sheets

DEVELOPING AGENT CONTAINER PACKAGE UNIT, PACKING RECEPTACLE FOR DEVELOPING AGENT CONTAINER, AND PACKING METHOD OF DEVELOPING AGENT CONTAINER

CROSS-REFERENCE TO RELATED APPLICATIONS

This application claims priority under 35 U.S.C. §119(a) from Korean Patent Application No. 2007-93344 filed Sep. 13, 2007 in the Korean Intellectual Property Office, the disclosure of which is incorporated herein by reference in its entirety.

BACKGROUND OF THE INVENTION

1. Field of the Invention

The present general inventive concept relates to a package unit for packing a developing agent container storing a developing agent for an image forming apparatus. More particularly, the present general inventive concept relates to a package unit usable with a developing agent container capable of preventing a developing agent stored in a developing agent storing portion of the developing agent container from leaning to one side thereof and cohering, a packing receptacle, and a method of packing a developing agent container in the packing receptacle.

2. Description of the Related Art

An image forming apparatus of an electrostatic latent image type, such as a laser printer, a facsimile machine, a composite apparatus, and the like, has been widely used not only in companies requiring a lot of printing work but also in homes due to high speed and high quality printing, and a relatively low price thereof.

The image forming apparatus of an electrostatic latent image type uses an exposure unit, such as an LSU, LED, etc., to scan a light beam onto a photosensitive medium, thereby forming electrostatic latent images thereon. Developing agent, such as toner, etc., is supplied to the photosensitive medium by a supplying member and a developing member, thereby developing the electrostatic latent images. The developed images are transferred onto a printing medium, and then fused thereon. After that, the printing medium having the fused image thereon is discharged. During this process, at least one member of the module referred to as a developing cartridge including the photosensitive medium, the developing member, the supplying member, and a developing agent storing portion, etc. may have a shorter lifespan compared to the rest of the image forming apparatus. Therefore, when one member of the developing cartridge becomes worn and useless, it needs to be replaced.

Accordingly, the developing cartridge is manufactured and sold separately from the rest of the image forming apparatus. Therefore, a user buys a new developing cartridge and can easily replace the worn developing cartridge with the new one.

FIG. 1 illustrates a conventional packing receptacle 1 for a standard developing cartridge 2. Referring to FIG. 1, the developing cartridge 2 may be put in a sealing bag 3, opposite ends of the developing cartridge 2 are received by preventing members 4, and then, the developing cartridge 2 is inserted in an outer packing box 6.

The conventional packing receptacle 1 generally has no problem containing the developing cartridge 2.

However, when the packing receptacle 1 is carried so that the developing cartridge 2 is set vertically, i.e., the direction of its longitudinal axis is vertically aligned, a problem can arise (as illustrated at FIG. 2). When the developing cartridge 2 is positioned vertically, a developing agent, contained inside, may collect at the bottom of the developing cartridge, such as the position indicated by reference letter C in FIG. 2. The developing agent is composed of powder, and it is cohesive. So if the developing cartridge 2 has been set in the longitudinal axis direction (as indicated by gravitational force, F) for a long time during distribution thereof, the developing agent inside the developing cartridge 2 becomes problematically cohesive. Especially, when the packing receptacle 1 passes through a high temperature region or continuously receives vibration as the developing cartridge 2 is set in the longitudinal axis direction thereof, the developing agent is tamped and cohesive. For example, the glass transition temperature of the developing agent generally is approximately 60°. Therefore, when the developing cartridge 2 that is sealed in the sealing bag 3 and packed in the packing receptacle 1 passes through an equatorial region, the temperature inside the sealing bag 3 is easily increased over 60° so that physical properties of the developing agent are changed. These environmental effects exacerbate the cohesion problem of the developing agent. When the developing cartridge 2 is carried in the longitudinal axis direction instead of, for example, horizontally (indicated by axis B at FIG. 2), the developing agent in the developing cartridge 2 continuously receives vibration so that the cohesion of the developing agent is also accelerated.

FIG. 2 illustrates a force, F, operating on the developing cartridge 2 when the developing cartridge 2 is packed using the conventional packing receptacle 1 and is set in the longitudinal axis direction thereof. As illustrated in FIG. 2, when the developing cartridge 2 is set in the longitudinal axis direction thereof during distribution, the developing agent gathers at the bottom of the developing cartridge due to gravity, so that the cohesive force of the developing agent is increased.

The conventional packing receptacle 1 may have an inner packing and the outer packing box 6 enclosing it. The outer packing box 6 generally has a hexahedron shape. Therefore, when the packing receptacle 1 packed with the developing cartridge 2 is carried, one of six side surfaces of the outer packing box 6 becomes a bottom surface thereof. Therefore, the developing cartridge 2 in the packing receptacle 1 assumes six postures as any one of the six side surfaces of the outer packing box 6 is the bottom surface thereof. In two postures among the six postures thereof, the developing cartridge 2 is set in the longitudinal axial direction during distribution. In this case, the above-described problem may arise.

When the user mounts the developing cartridge 2 to the image forming apparatus, and turns on the image forming apparatus, a supplying member mixes or agitates the developing agent to supply the developing agent in the developing cartridge 2. If the developing agent has become overly cohesive, the supplying member needs a force larger than the cohesive force of the developing agent to supply the developing agent. Therefore, the supplying member is overloaded so that a driving motor, disposed in the main body of the image forming apparatus, to supply a driving force to the supplying member, cannot rotate.

No special measures have yet been taken to deal with the above described problems during distribution. Alternatively, a relatively large torque motor has been used to address the problem. However, this causes manufacturing costs to increase and compactness of the image forming apparatus to be lost.

SUMMARY OF THE INVENTION

The present general inventive concept provides a developing agent container package unit to prevent a developing agent stored in a developing agent container from being cohesive during distribution, a packing receptacle for a developing agent container, and a method of packing a developing agent container.

Additional aspects and utilities of the present general inventive concept will be set forth in part in the description which follows and, in part, will be obvious from the description, or may be learned by practice of the general inventive concept.

The foregoing and/or other aspect and utilities of the present general inventive concept can substantially be achieved by providing a developing agent container package unit, which includes a packing case, a developing agent container received inside the packing case, and storing a developing agent, and storing a developing agent, a supporting member to support the developing agent container so that the developing agent container is inclined with respect to one side surface of the packing case.

The supporting member may be formed to support the developing agent container so that a longitudinal axis of the developing agent container is inclined with respect to the one side surface of the packing case.

Here, the inclined angle defined by the longitudinal axis of the developing agent container and the one side surface of the packing case may be in a range of approximately 30° to 60°.

The supporting member may include a receiving portion to receive the developing agent container.

The receiving portion may be formed to support the developing agent container in at least two sections.

Also, the supporting member may include portions forming at least one groove or opening formed around the receiving portion.

The supporting member may be formed to be divided into at least two parts.

Here, the supporting member may include a lower supporting member to support a bottom surface of the developing agent container; and an upper supporting member to support a top surface of the developing agent container.

Also, the supporting member may include a first supporting member to support a first end of the developing agent container in the longitudinal axis direction thereof; and a second supporting member to support a second end of the developing agent container in the longitudinal axis direction thereof.

The packing case may be formed substantially in a hexahedron shape, and the packing case and the supporting member may be formed integrally.

The developing agent container may be a developing cartridge having a developing agent storing portion, and the longitudinal axis direction thereof is a lengthwise direction of the developing agent storing portion.

The supporting member may support the developing agent container as the developing agent container is put in a sealing bag.

Also, the supporting member may be formed of a material to absorb impact, and selected from the group consisting of paper, vinyl, rubber, and Styrofoam.

The foregoing and/or other aspects and utilities of the present general inventive concept can also be achieved by providing a packing receptacle usable with a developing agent container in a developing agent container package unit, the packing receptacle, which may include a packing case and a supporting member to support a developing agent container in the packing case so that the developing agent container is inclined with respect to one side of the packing case.

The supporting member may include a receiving portion to receive the developing agent container.

Also, the supporting member may include portions forming at least one groove or opening formed around the receiving portion.

The developing agent container may be a developing cartridge having a developing agent storing portion, and the longitudinal axis direction thereof is a lengthwise direction of the developing agent storing portion.

Also, the packing case and the supporting member may be formed integrally.

The foregoing and/or other aspects and utilities of the present general inventive concept can also be achieved by providing a method of packing a developing agent container, which includes preparing a packing receptacle; and causing the developing agent container to be received inside the packing receptacle so that the developing agent container is inclined with respect to one side surface of the packing receptacle.

The developing agent container may be received in the packing receptacle so that a longitudinal axis of the developing agent container is inclined with respect to the one side surface of the packing receptacle.

Here, the inclined angle defined by the longitudinal axis of the developing agent container and the one side surface of the packing case may be in a range of approximately 30° to 60°.

The developing agent container may be a developing cartridge having a developing agent storing portion, and the longitudinal axis direction thereof is a lengthwise direction of the developing agent storing portion.

Also, the developing agent container may be received in the packing receptacle as the developing agent container is put in a sealing bag.

The foregoing and/or other aspects and utilities of the present general inventive concept can also be achieved by providing a method of assembling an image forming apparatus, the method including providing a developing cartridge packed using a packing technique wherein the packing technique includes preparing a packing receptacle and causing the developing cartridge to be received inside the packing receptacle so that the developing cartridge is inclined with respect to one side surface of the packing receptacle.

The foregoing and/or other aspects and utilities of the present general inventive concept can also be achieved by providing a packaging unit usable in a developing agent container, the packaging unit including a packaging case and a developing agent container storing a developing agent and received inside the package, the developing agent container to be inclined with respect to a side of the packing case.

The foregoing and/or other aspects and utilities of the present general inventive concept can also be achieved by providing a packaging unit usable in a developing agent container, the packaging unit including a packing case and a developing agent container storing a developing agent and received inside the packing case, the developing agent container to be inclined with respect to a side of the packing case.

The angle may be about 45 degrees between longitudinal axes of the developing agent container and the side of the packing case.

The developing agent container may have a dimension of a length and a width shorter than the length, and the length of the developing agent container is inclined with respect to the one side of the package.

The packing case may include a top side, a bottom, and the side formed between the top side and the bottom, and the length is disposed in a longitudinal direction to have an inclined angle smaller than a right angle with respect to the inclined angle.

The packing case may include a top side, a bottom side, and a plurality of sides formed between the top side and the bottom side, one of the plurality of sides of the packing case forming an angle with the developing agent container.

A support member may be disposed between the packaging case and the developing agent container to maintain a position of the developing agent container with respect to the packaging case.

Also, the support member and the packaging case may be formed in a single integral body.

The foregoing and/or other aspects and utilities of the present general inventive concept can also be achieved by providing a method of using a packaging unit having a developing agent container, the method including storing a developing agent in a developing agent container and disposing the developing agent container inside a packing case such that the developing agent container is inclined with respect to a side of the packing case.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
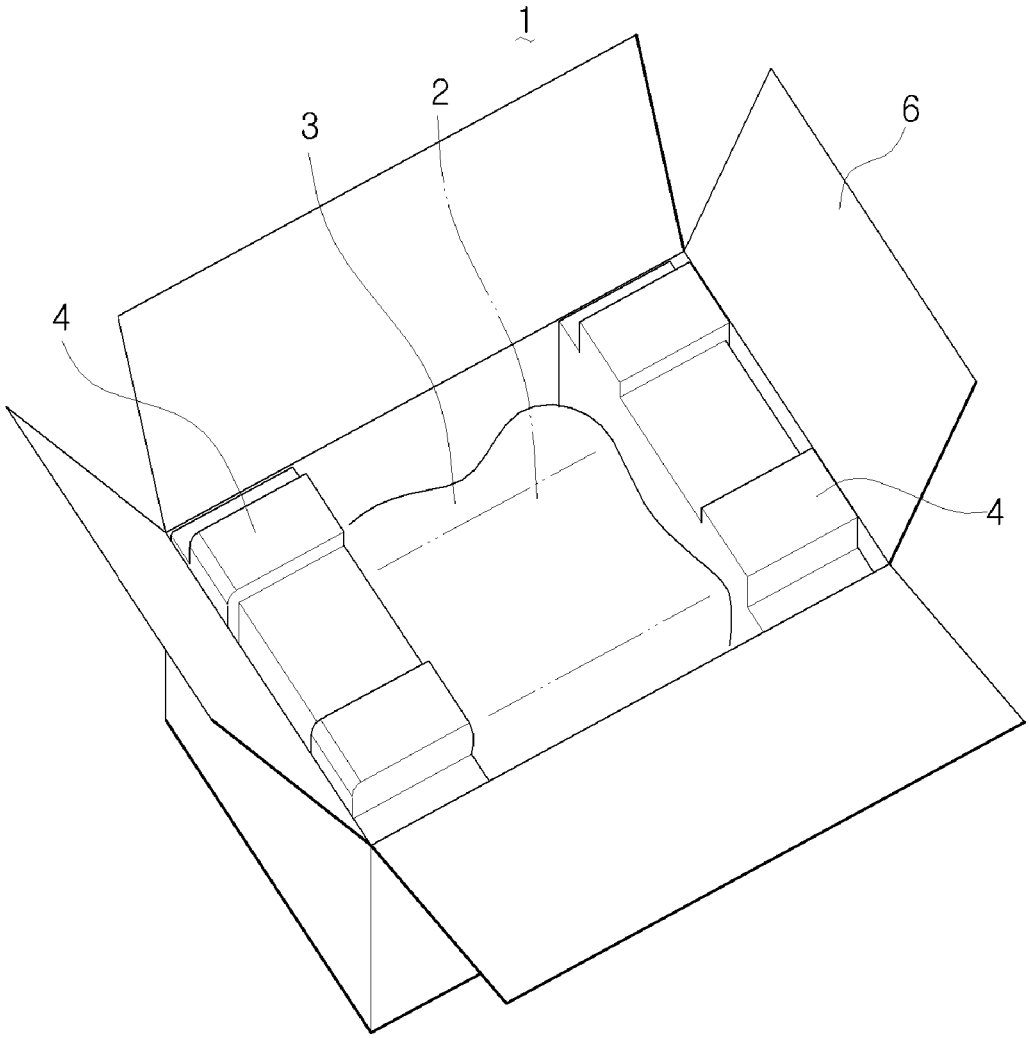
FIG. 1 (PRIOR ART)
FIG. 1 is a perspective view illustrating a conventional developing agent container package unit.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

The subject matter defined in the description, such as a detailed construction and elements thereof, are provided to assist in a comprehensive understanding of the present general inventive concept. Thus, it is apparent that the present inventive concept may be carried out without that defined subject matter. Also, well-known functions or constructions are omitted to provide a clear and concise description of exemplary embodiments herein.

Figure 3:
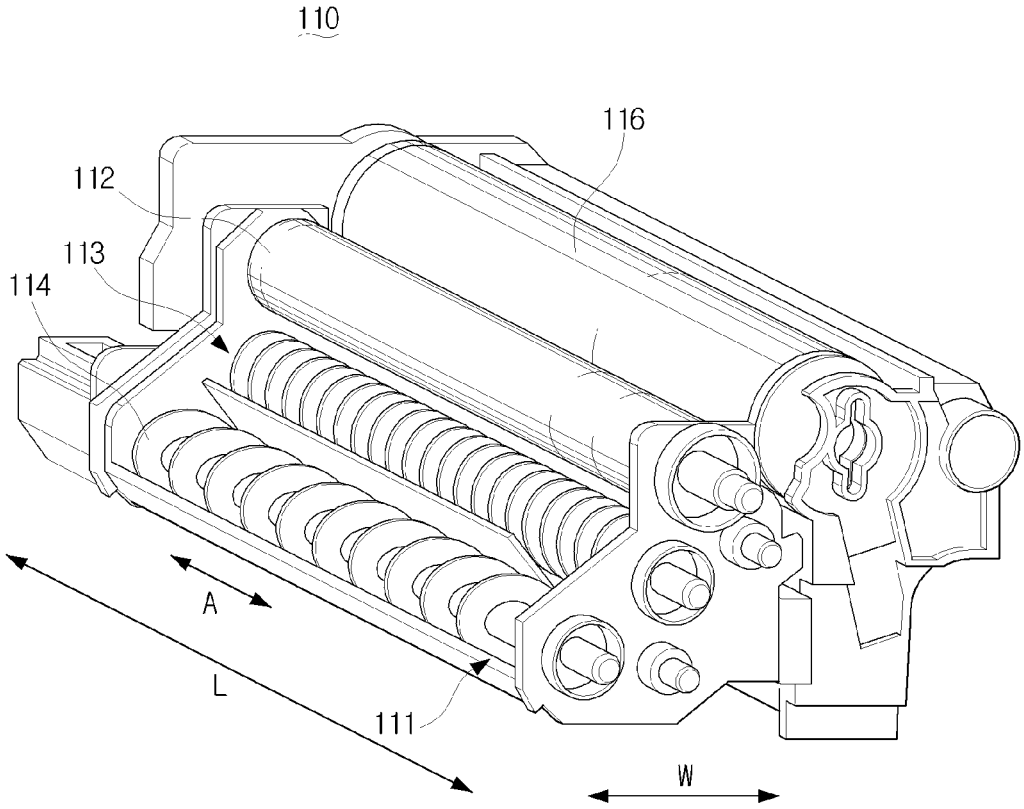
FIG. 3 is a perspective view illustrating a developing agent container usable with a developing agent container package unit according to an exemplary embodiment of the present general inventive concept.

FIG. 3 is a partially cutaway perspective view illustrating a developing agent container 110 having a longitudinal axis, labeled "A," according to an exemplary embodiment of the present general inventive concept. However, in FIG. 3, the developing agent container 110 is partially cut away to show the interior structure of a developing agent storing portion 111 thereof. Here, the developing agent container 110 may be a developing cartridge with the developing agent storing portion 111.

The developing agent container 110 may be a container to store a developing agent. Alternatively, the developing agent container 110 may include not only the container to store the developing agent but also at least one element of a printing unit, including a photosensitive medium 116 on which an electrostatic latent image is formed, a developing member 112 to supply the developing agent to the photosensitive medium 116, a supplying member 113 to supply the developing agent to the developing member 112, an agitator 114 to agitate or supply the developing agent to the supplying member 113 or the developing member 112, a charging member (not illustrated) to charge the photosensitive medium 116, a cleaning member (not illustrated) to clean the photosensitive medium 116, etc., according to the structure thereof. Hereinafter, the developing agent container 110 can be referred to as a developing cartridge having all or some of the members as described above.

An image forming apparatus (not shown except for the developing agent container 110) of an electrostatic latent image type uses an exposure unit (not shown), such as an LSU, LED, etc., to scan a light beam onto the photosensitive medium 116, thereby forming electrostatic latent images thereon. After the electrostatic latent images are formed, the supplying member 113 and developing member 112 supply the developing agent 115 such as toner to the photosensitive medium 116 to develop the electrostatic latent images. The developed images are transferred onto a printing medium and then fused thereon. The printing medium having images fused thereon is discharged outside. It should be noted that while the developing agent 115 is indicated to the exterior of the developing agent container 110 in FIG. 4 for ease of illustration, in fact the developing agent 115 is typically stored within the developing agent storing portion 111 of the developing agent container 110.

When the developing agent container 110 is a container to store the developing agent, the developing agent container 110 may have a length L in a longitudinal direction and a width W shorter than the length L. When the developing agent container 110 is a container combined with at least one element of a printing unit, the developing agent container 110 may have a length L and a width W. The length L may be parallel to a rotation axis of the element of the printing unit. According to the present embodiment, the length L of the developing agent container 110 is inclined with respect to a side of the package unit and/or a supporting member disposed between the package unit and the developing agent container 110.

The members of the developing agent container 110 may be formed substantially in a roller shape as illustrated in FIG. 3. Alternatively, the members may be formed substantially in an elliptical shape using a belt. The developing agent storing portion 111 inside the developing agent container 110 is formed substantially in a cylindrical shape as illustrated in FIG. 3. Alternatively the developing agent storing portion 111 may be formed substantially in a prism shape with predetermined section and length. Here, the direction of the longitudinal axis A is a lengthwise direction along the cylinder or the prism forming the developing agent storing portion 111. Also, the developing agent container 110 may be put in a sealing bag (not shown), which prevents the photosensitive medium 116 of the developing agent container 110 from being damaged by light and the developing agent 115 from being leaked. The sealing bag is similar to the sealing bag 3 (FIG. 1) used in the conventional packing method.

Figure 4:
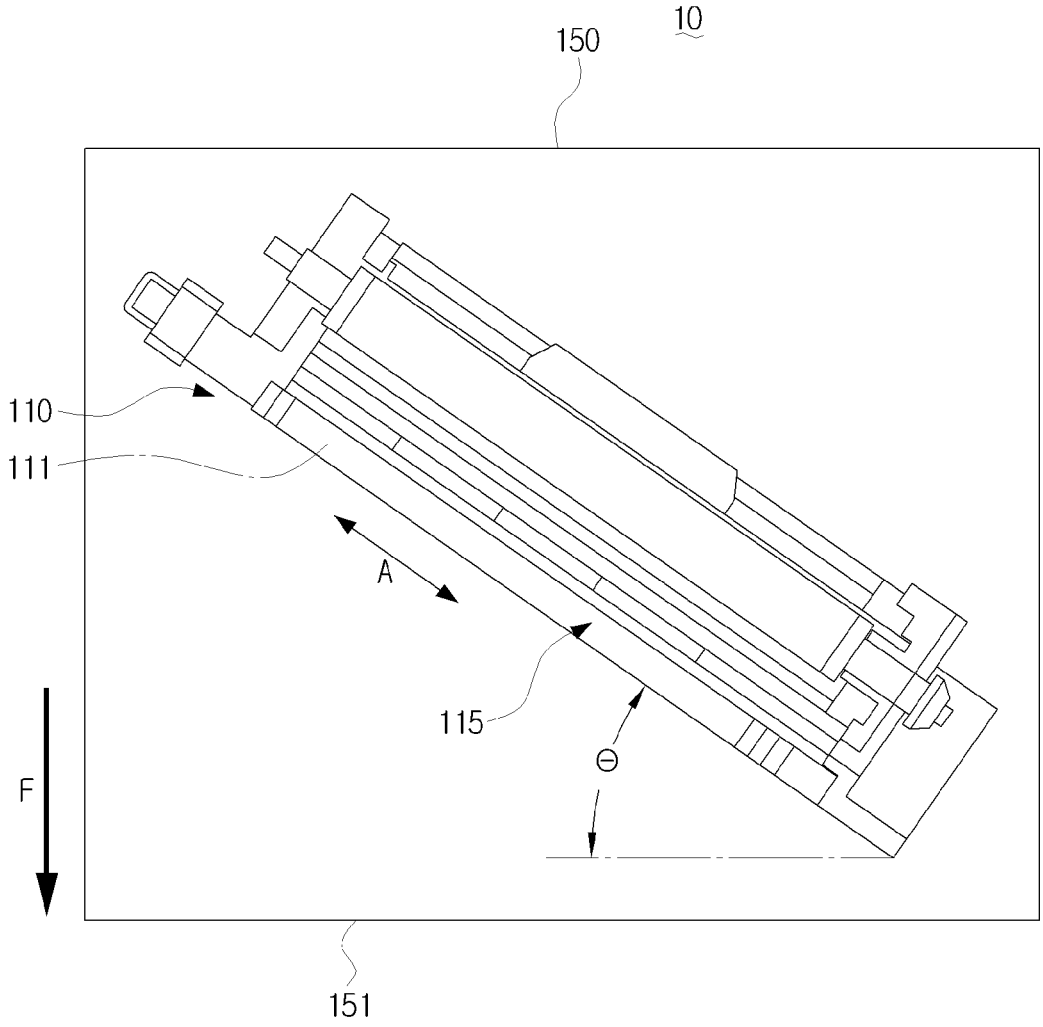
FIG. 4 is an isometric view illustrating a gravitational force applied to developing agent stored in an inclined developing agent container received in a developing agent container package unit according to an exemplary embodiment of the present general inventive concept during distribution.

FIG. 4 is an isometric view illustrating a force applied to the developing agent 115 stored in inclined the developing agent container 110 received in a packing case 150 of a developing agent container package unit 10 according to an exemplary embodiment of the present general inventive concept during distribution. The packing case 150 may be a hexahedron packing case, and the developing agent container 110 may be inclined with respect to sides 151 of the packing case 150. The present general inventive concept is not limited to a packing case which is hexahedron. During distribution of the developing agent container package unit 10 according to an exemplary embodiment of the present general inventive concept, the force operating on the developing agent container 110 is described with reference to FIG. 4.

Figure 2:
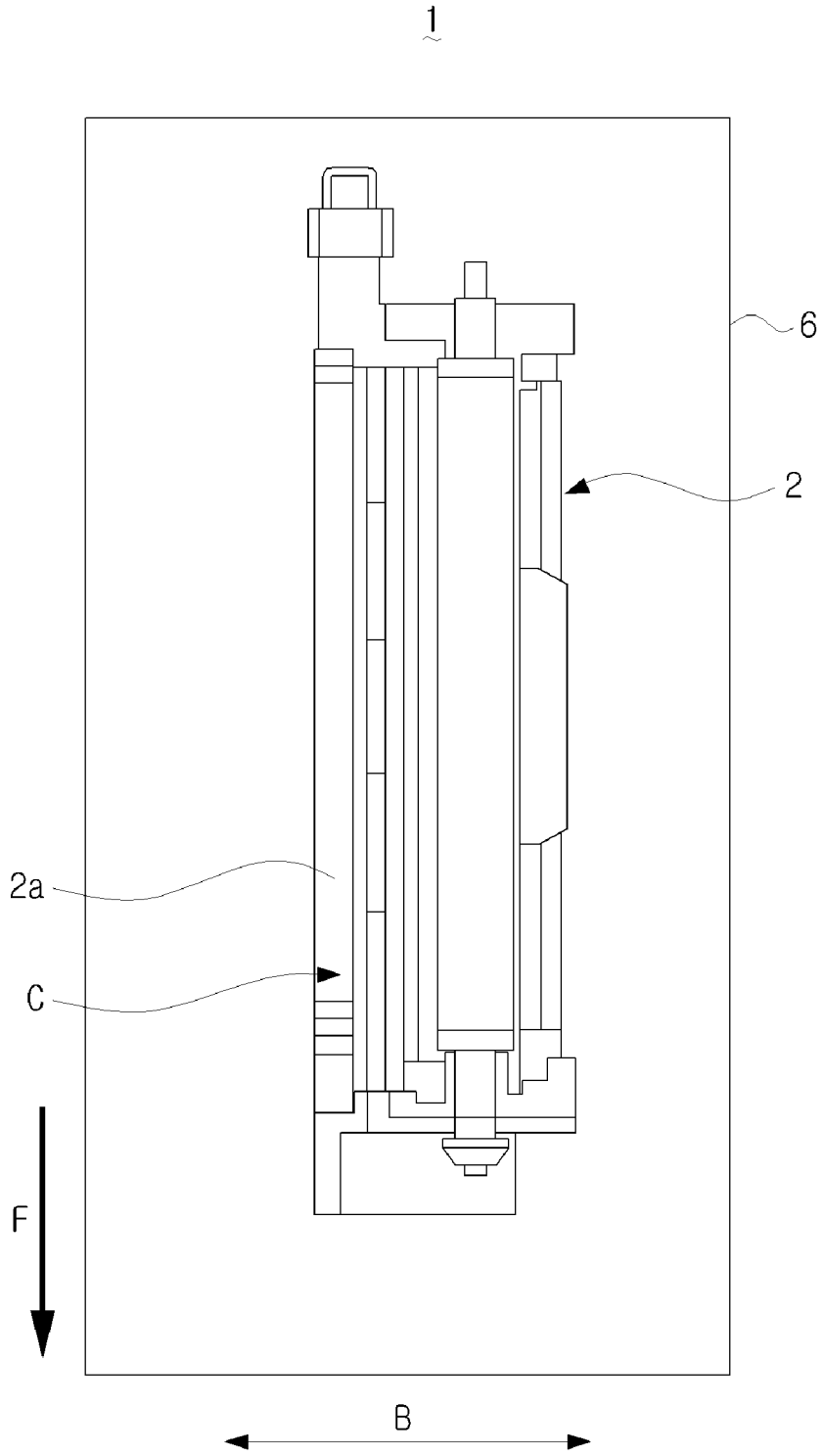
FIG. 2 (PRIOR ART)
FIG. 2 is an isometric view schematically illustrating a force applied to developing agent in a developing agent container when a conventional developing agent container package unit is carried as the developing agent container therein is set in its longitudinal axis direction thereof during distribution.

When the developing agent container 110 is packed in the packing case 150 so that the direction of the longitudinal axis A thereof is aligned parallel to the axis B of FIG. 2, that is, horizontally during distribution, the smallest gravitational force is applied to the developing agent container 110. Also, when the developing agent container 110 is packed in the hexahedron packing case 150 so that the direction of the longitudinal axis A thereof is aligned to parallel to the gravitational direction F as illustrated in FIG. 2 during distribution, the largest gravitational force is applied to the developing agent container 110. However, the developing agent container 110, which is set horizontally, may be set vertically as illustrated in FIG. 2 during distribution, for example, by a shipping clerk. Considering that the posture of the developing agent container 110 can be easily changed from the horizontal state to the vertical state of FIG. 2 during distribution, it may be said that when the developing agent container 110 is inclined as illustrated in FIG. 4 (relative to the packing case 150), the smallest vertical component of gravitational force is applied to the developing agent 115 stored in the developing agent storing portion 111 of the developing agent container 110.

In this case, the minimized vertical component of gravitational force applied to the developing agent 115 of the developing agent container 110 may be represented using Formula 1.

$$F1 = W \sin\theta (Kgf) \qquad \text{<Formula 1>}$$

Here, F1 is the force applied to the developing agent 115, W is the weight of the developing agent 115 in the gravitational direction F, and θ is an angle between the longitudinal axis A of the developing agent container 110 and the side surface 151 of the packing case 150. In this embodiment, θ is in a range of $0° < \theta < 90°$.

As a result, when the developing agent container 110 is inclined at 45° with respect to the side surface 151 of the packing case 10, the vertical component of gravitational force, F1, applied to the developing agent 115 can be calculated as below.

In other words, F1=W sin 45°=0.707 W (Kgf). Therefore, the force F1 applied to the developing agent 115 of the developing agent container 110 packed in the developing agent container package unit 10 according to an exemplary embodiment of the present general inventive concept is smaller than the magnitude of the total gravitational force, that is, F1=W (Kgf) applied to the developing agent 115 of the developing agent container 110 packed by the conventional packing method (illustrated in FIG. 2). As the force F1 applied to the developing agent 115 is reduced, the force causing the developing agent 115 of the developing agent container 110 to cohere is also decreased. As a result, during distribution the cohesion of the developing agent 115 may be prevented. In practice, most of vertical vibration that causes the developing agent 115 to cohere may be canceled by an inclined frame surface of the developing agent container 110 so that the cohesion of the developing agent 115 caused by vibration is smaller than that caused by the 0.707 W (Kgf). If the developing agent 115 stored in the developing agent container 110 is not cohesive, when the developing agent container 110, that is to say, the developing cartridge 110 is mounted to the image forming apparatus (not illustrated), a driving motor (not illustrated) to drive the developing cartridge 110 may not be overloaded.

Hereinafter, the developing agent container package unit 10 according to exemplary embodiments of the present general inventive concept will be explained.

Figure 5:
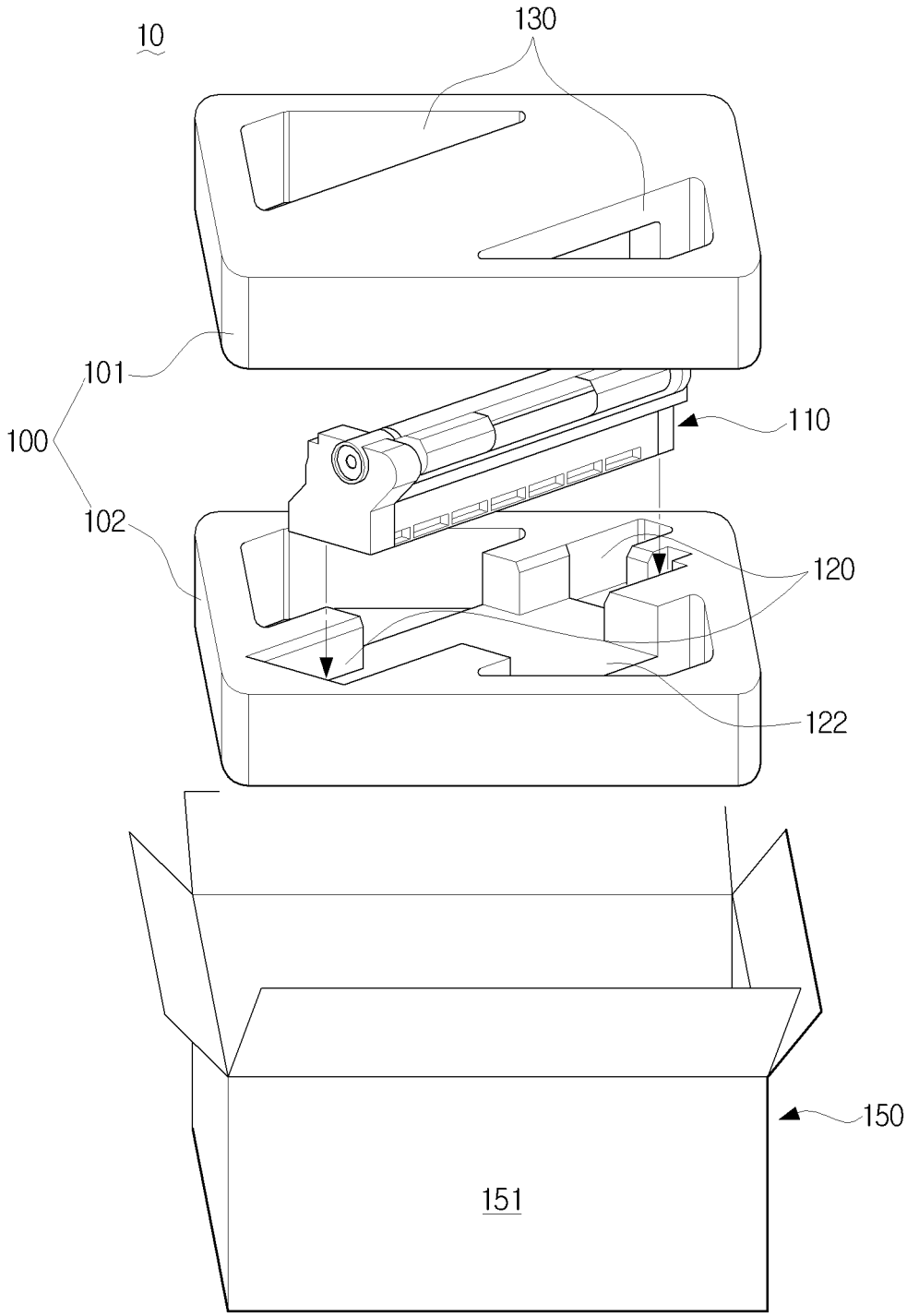
FIGS. 5 to 8 are perspective views illustrating developing agent container package units according to exemplary embodiments of the present general inventive concept.

FIG. 5 is a perspective view illustrating the unit 10 according to an exemplary embodiment of the present general inventive concept. Referring to FIG. 5, the developing agent container package unit 10 includes the packing case 150, the developing agent container 110, and a supporting member 100.

The packing case 150 receives the supporting member 100 to support the developing agent container 110. The packing case 150 may be formed substantially in a hexahedron shape so that a plurality of the developing agent container package units 10 can be easily piled up during distribution. In this exemplary embodiment, the developing cartridge, including the developing agent storing portion 111 storing the developing agent 115, the photosensitive medium 116, the developing member 112, and the supplying member 113, etc., may be used as the developing agent container 110 to contain the developing agent 115 therein.

The supporting member 100 is received in the packing case 150 and supports the developing agent container 110 to be inclined at a predetermined angle with respect to one side surface 151 of the packing case 150. As arrows illustrate in FIG. 5, the developing agent container 110 is inserted in a lower supporting member 102. The predetermined angle, between the longitudinal axis A of the developing agent container 110 (see FIG. 4) and one side surface 151 of case 150 (see FIG. 4), may be in a range of approximately 30° to 60°. The angle range of approximately 30° to 60° may be determined by considering below. According to Formula 1, when the predetermined angle is 30°, the smaller force is applied. However, when the predetermined angle is 30°, an angle of the developing agent container 110 with respect to a near side surface is 60°, i.e., the complementary angle to the predetermined 30° angle. That is, when the developing agent container package unit 10 is set up in the complementary direction, the predetermined angle becomes 60°. Therefore, the predetermined angle may be determined in the range of approximately 30° to 60°. Especially, considering two near side surfaces at a right angle to each other, it is preferable that the predetermined angle is approximately 45°. The supporting member 100 has a receiving portion 120 formed in a mating shape corresponding to the developing agent container 110. Also, the receiving portion 120, as illustrated in FIG. 5, has at least two sections to support the developing agent container 110. When the developing agent container 110 is inserted in the receiving portion 120, the developing agent container 110 is inclined with respect to one side surface 151 of the packing case 150.

The supporting member 100 may have portions to form at least one opening 130 around the receiving portion 120. At least one opening 130 may be used as a handle for easily carrying the supporting member 100 having the developing agent container 110 received thereon. Since the supporting member 100 may be easily molded, causing the weight of the supporting member 100 to be reduced over that of solid configurations, this embodiment has a decreased manufacturing cost. Also, the opening 130 can function as an air hole so that the supporting member 100 effectively absorbs impact. Furthermore, the supporting member 100 may have a grip portion 122 extending from the receiving portion 120 so that the supporting member 100, having the developing agent container 110 received within, can be easily taken out from the packing case 150.

In this exemplary embodiment, the supporting member 100 includes the lower supporting member 102 supporting a bottom surface of the developing agent container 110 and an upper supporting member 101 supporting a top surface of the developing agent container 110, so can be divided into two parts.

After the developing agent container 110 is received in the receiving portions 120 of the upper and lower supporting members 101 and 102, the supporting member 100 is inserted into the packing case 150 so that the process of packing the developing agent container 110 is completed to form the developing agent container package unit 10.

Figure 6:
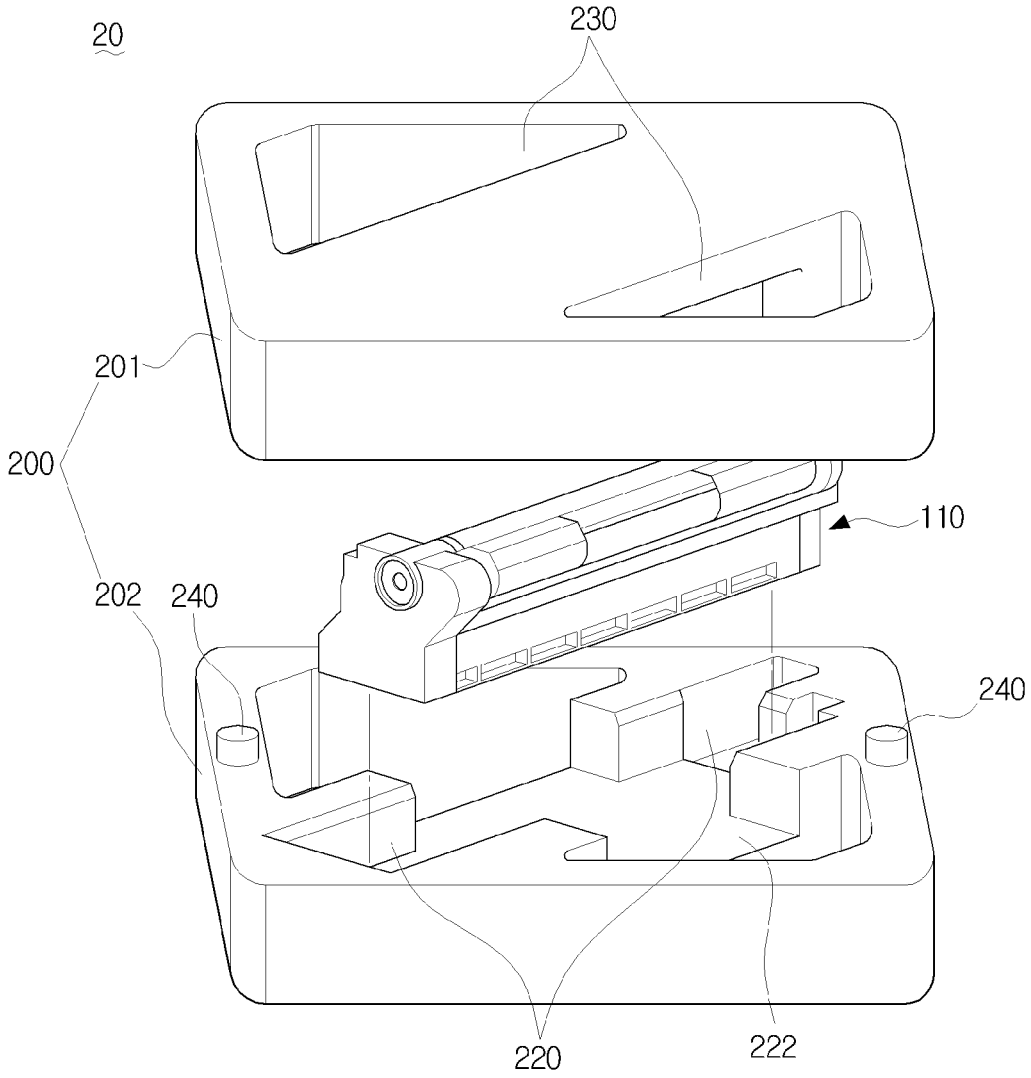

FIG. 6 illustrates the developing agent container package unit 20 according to an exemplary embodiment of the present general inventive concept. As illustrated in FIG. 6, the developing agent container package unit 20 does not include the separate packing case 150 of the developing agent container package unit 10 according to the exemplary embodiment as described above, with respect to FIG. 5. That is, the packing case function is formed integrally with a supporting member 200. Therefore, an outer surface of the supporting member 200 effectively forms the packing case. The structure of the developing agent container package unit 20 according to this exemplary embodiment may be substantially the same as that of the exemplary embodiment as illustrated in FIG. 5 except for the absence of a stand-alone packing case. Therefore, a detailed explanation of the developing agent container package unit 20 is omitted. However, because the developing agent container package unit 20 according to this exemplary embodiment does not have the packing case 150, a lower supporting member 202 is provided with projections 240 formed thereon, and an upper supporting member 201, is provided with grooves (not illustrated for clarity) into which the projections 240 are matingly, grippingly inserted so that the lower and upper supporting members 202 and 201 will not be separated from each other during distribution.

Therefore the developing agent container package unit 20 may be used not only when the developing agent container 110 is independently sold as expendable but also when the developing agent container 110 is packed and sold together with the image forming apparatus such as a printer, a facsimile machine, a composite machine, etc.

Figure 7:
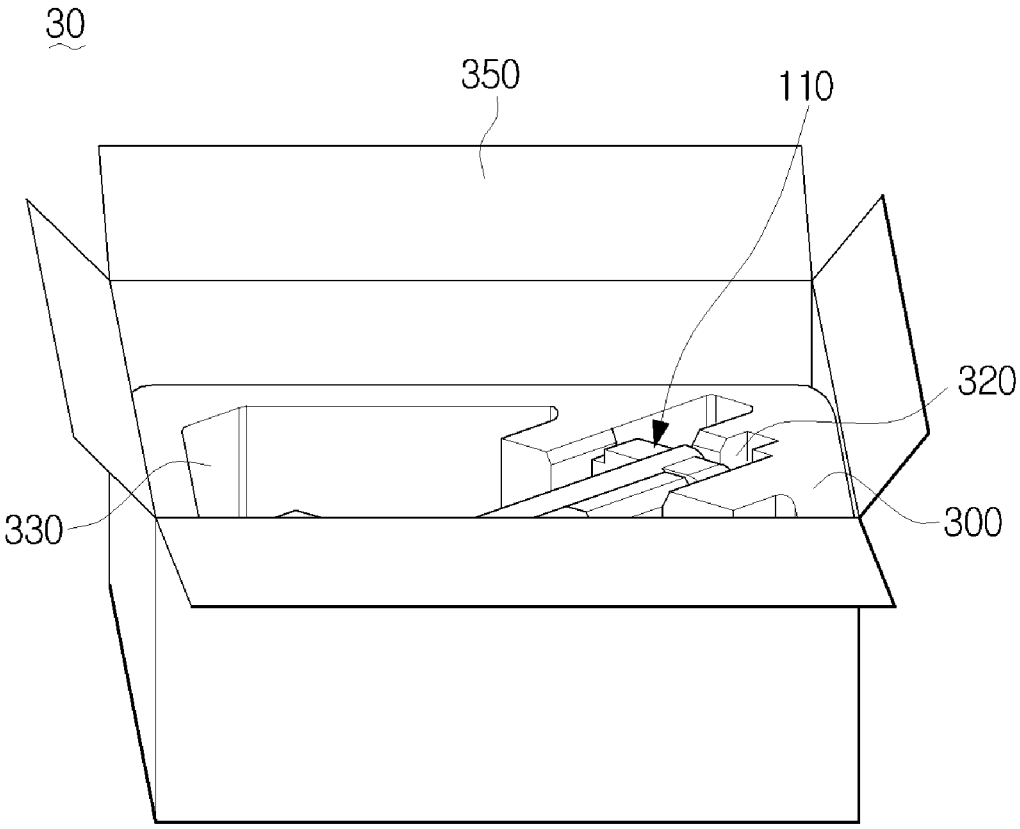

FIG. 7 illustrates the developing agent container package unit 30 according to an exemplary embodiment of the present general inventive concept. As illustrated in FIG. 7, the developing agent container package unit 30 according to this exemplary embodiment has a supporting member 300 formed in a single piece. Portions forming at least one groove 330 may be formed around portions to form a receiving portion 320. At least one groove 330 may have substantially the same function as that of opening 130 of the supporting member 100 according to the exemplary embodiment as illustrated in FIG. 5. The structure of the developing agent container package unit 30 according to this exemplary embodiment may be substantially the same as that of the first exemplary embodiment as illustrated in FIG. 5 except for the groove 330. Therefore, a detailed explanation of the developing agent container package unit 30 is omitted.

Figure 8:
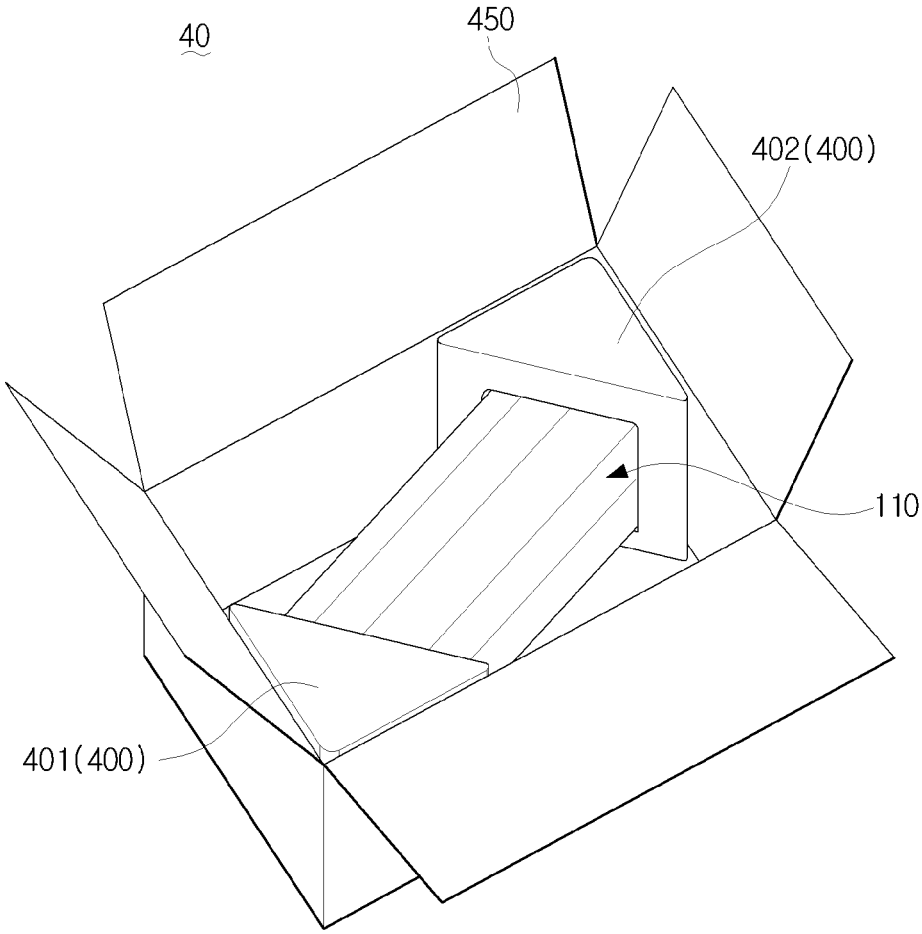

FIG. 8 illustrates the developing agent container package unit 40 according to an exemplary embodiment of the present general inventive concept. As illustrated in FIG. 8, the developing agent container package unit 40 according to this exemplary embodiment includes a first supporting member 401 and a second supporting member 402 supporting opposite ends of the developing agent container 110 in the longitudinal axis direction A thereof. The first and second supporting members 401 and 402 may be formed to be separated from each other and to be received in a packing case 450. The structure of the developing agent container package unit 40 according to this exemplary embodiment may be substantially the same as that of the exemplary embodiment as illustrated in FIG. 5 except for the supporting member 400. Therefore, a detailed explanation of the developing agent container package unit 40 is omitted. Alternatively, although not illustrated, the supporting member 400 may be formed so that the first and second supporting members 401 and 402 completely enclose the developing agent container 110, and are separated from each other in a diagonal direction of the packing case 450 at a center of the longitudinal axis direction A of the developing agent container 110.

Hereinafter, a packing receptacle for the developing agent container 110 according to an exemplary embodiment of the present general inventive concept will be explained. The packing receptacle for the developing agent container 110 according to an exemplary embodiment of the present general inventive concept may include the packing case 150, 350 or 450 and the supporting member 100, 200, 300 or 400 except for the developing agent container 110 of the developing agent container package units 10, 20, 30 or 40 as described above. As described above, the supporting member 100, 200, 300, or 400 has the receiving portion 120, 220 or 320 to receive the developing agent container 110 and portions to form at least one groove 330 or opening 130 or 230 formed around the receiving portion 120, 220, or 320, so as to support the developing agent container 110 to be inclined with respect to one side surface of the packing case 150, 350 or 450 or the supporting member 200.

Figure 9:
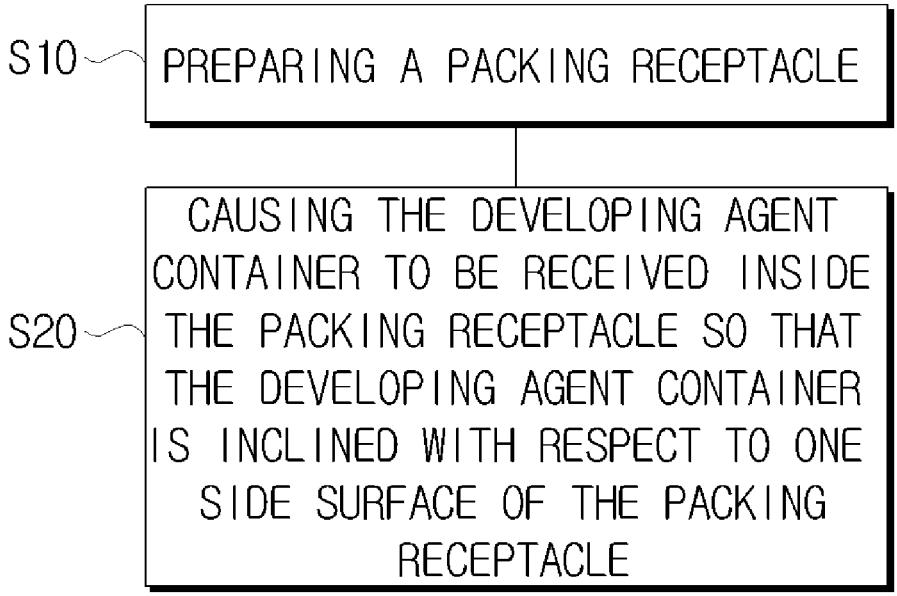
FIG. 9 is a flowchart illustrating a packing method of a developing agent container according to an exemplary embodiment of the present general inventive concept.

FIG. 9 is a flowchart to illustrate a method of packing for the developing agent container 110 according to an exemplary embodiment of the present general inventive concept.

Hereinafter, the packing method for the developing agent container 110 according to an exemplary embodiment of the present general inventive concept will be explained with respect to FIG. 9.

For packing the developing agent container 110, the packing receptacle is prepared (step 10). The packing receptacle in which the developing agent container 110 is packed may be substantially the same as the packing receptacle described above.

The developing agent container 110 is received inside the packing receptacle, so the developing agent container 110 is inclined with respect to one side surface of the packing receptacle (step 20). The developing agent container 110 may be inclinedly received in the packing receptacle using one of various methods as described above. At this time, the developing agent container 110 may be received in the packing receptacle so that the longitudinal axis direction A of the developing agent container 110, that is, the lengthwise direction of the developing agent storing portion 111 is inclined with respect to one side surface of the packing receptacle.

With the developing agent container package unit, the packing receptacle, and the packing method cooperatively acting according to an exemplary embodiment of the present general inventive concept, the developing agent container 110 is prevented from being set vertical to the ground during distribution. As a result, the cohesion of the developing agent 115 in the longitudinal axis direction A is decreased compared to the conventional developing agent container package unit. Therefore, after mounting the developing agent container 110 to the main body of the image forming apparatus, the user turns it on so that the supplying member 113 mixes or agitates the developing agent 115. At this time, because the developing agent 115 has a weak cohesive force, the force applied to the supplying member 113 is not large. Therefore, the supplying member 113 is not overloaded so that the driving motor (not illustrated) disposed in the main body (not illustrated) can rotate.

In other words, even when the conventional developing agent container 110, motor, and main body are used without additional device or cost, the problem caused by the cohesion of the developing agent 115 can be solved.

Also, the packing receptacle according to an exemplary embodiment of the present general inventive concept can maximally absorb vibration and impact from outside so that vibration and impact transmitted to the developing agent container 110 is minimized.

Furthermore, the supporting member may have portions to form at least one opening around the receiving portion. At least one opening may be used as a handle when the user carries the supporting member having the developing agent container 110 received thereon. Also, the opening may cause the supporting member to be easily molded, weight of the supporting member to be reduced and the manufacturing cost of the supporting member to be decreased. Also, the opening can function as an air hole so that the supporting member effectively absorbs impact. Furthermore, the supporting member may have the grip portion extending from the supporting member beside the supporting member so that the supporting member having the developing agent container received thereon can be easily taken out from the packing case.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A developing agent container package unit comprising:

a packing case including a top end and a bottom end and a plurality of side surfaces extending vertically between the top end and the bottom end to define a plurality of corners;

a developing agent container including first and second ends and storing toner therein and disposed inside the packing case; and a supporting member having at least one projection and at least one groove formed thereon, the supporting member disposed along opposing longitudinal sides of the developing agent container supporting the developing agent container containing toner therein, so that the developing agent container is inclined with respect to all side surfaces extending between the top end and the bottom end of the packing case and a first end of the developing agent container is disposed adjacent a first corner of the packing case and a second end of the developing agent container is disposed adjacent a second corner that is diagonally opposite from the first corner, wherein the developing agent container has a longitudinal axis which is inclined with respect to one side surface of the packing case, and wherein the at least one projection corresponds to the at least one groove.

2. The developing agent container package unit of claim 1, wherein an inclined angle defined by the longitudinal axis of the developing agent container and the one side surface of the packing case is in a range of approximately 30° to 60°.

3. The developing agent container package unit of claim 2, wherein the inclined angle is approximately 45°.

4. The developing agent container packaging unit of claim 1, wherein the supporting member comprises a receiving portion to receive the developing agent container.

5. The developing agent container package unit of claim 4, wherein the receiving portion is formed of at least two sections.

6. The developing agent container package unit of claim 5, wherein the supporting member includes portions forming at least one groove or opening formed around the receiving portion.

7. The developing agent container package unit of claim 6, wherein the supporting member is formed to be divided into at least two parts.

8. The developing agent container package unit of claim 7, wherein the supporting member further comprises:

a lower supporting member to support a bottom surface of the developing agent container; and an upper supporting member to support a top surface of the developing agent container.

9. The developing agent container package unit of claim 7, wherein the supporting member comprises:

a first supporting member to support a first end of the developing agent container in the longitudinal axis direction thereof; and a second supporting member to support a second end of the developing agent container in the longitudinal axis direction thereof.

10. The developing agent container package unit of claim 7, wherein the packing case is formed substantially in a hexahedron shape.

11. The developing agent container package unit of claim 1, wherein the packing case is integrally formed with the supporting member.

12. The developing agent container package unit of claim 1, wherein the developing agent container comprises:

a developing cartridge having a developing agent storing portion, and the longitudinal axis direction thereof is a lengthwise direction of the developing agent storing portion.

13. The developing agent container package unit of claim 1, wherein the supporting member supports the developing agent container, which is contained in a sealing bag.

14. The developing agent container package unit of claim 1, wherein the supporting member is formed of a material to absorb impact.

15. The developing agent container package unit of claim 14, wherein the material to absorb impact comprises a material selected from the group consisting of paper, vinyl, rubber, and Styrofoam.

16. A packing receptacle usable with a developing agent container in a developing agent container package unit, the packing receptacle comprising:

a packing case including a top end and a bottom end and a plurality of side surfaces extending vertically between the top end and the bottom end to define a plurality of corners;

a developing agent container including first and second ends and storing toner therein and disposed inside the packing case; and a supporting member having at least one projection and at least one groove formed thereon, the supporting member disposed along opposing longitudinal sides of the developing agent container supporting the developing agent container containing toner therein, so that the developing agent container is inclined with respect to all side surfaces extending between the top end and the bottom end of the packing case and a first end of the developing agent container is disposed adjacent a first corner of the packing case and a second end of the developing agent container is disposed adjacent a second corner that is diagonally opposite from the first corner, wherein a longitudinal axis of the developing agent container is aligned with a diagonal along a surface of the packing case, and wherein the at least one projection corresponds to the at least one groove.

17. The packing receptacle of claim 16, wherein the supporting member includes a receiving portion to receive the developing agent container.

18. The packing receptacle of claim 17, wherein the supporting member includes portions forming the at least one groove or opening formed around the receiving portion.

19. The packing receptacle of claim 16, wherein the developing agent container includes a developing cartridge having a developing agent storing portion, and a longitudinal axis direction thereof is a lengthwise direction of the developing agent storing portion.

20. The packing receptacle of claim 16, wherein the packing case is integrally formed with the supporting member.

21. A method of packing a developing agent container in a developing agent container package unit, the method comprising:

preparing a packing receptacle including a top end and a bottom end and a plurality of side surfaces extending vertically between the top end and the bottom end to define a plurality of corners; and causing the developing agent container containing toner therein, to be received inside the packing receptacle so that the developing agent container is inclined with respect to all side surfaces extending between the top end and the bottom end of the packing receptacle and a first end of the developing agent container is disposed adjacent a first corner of the packing receptacle and a second end of developing agent container is disposed adjacent a second corner that is diagonally opposite from the first corner by a supporting member disposed along opposing longitudinal sides of the developing agent container, the supporting member includes at least one projection and at least one groove corresponding to the at least one projection formed thereon, wherein the developing agent container is received in the packing receptacle so that a longitudinal axis of the developing agent container is inclined with respect to one side surface of the packing receptacle.

22. The packing method of claim 21, wherein an inclined angle defined by the longitudinal axis of the developing agent container and the one side surface of the packing case is in a range of approximately 30° to 60°.

23. The packing method of claim 22, wherein the inclined angle is approximately 45°.

24. The packing method of claim 21, wherein the developing agent container comprises a developing cartridge having a developing agent storing portion, and the longitudinal axis direction thereof is a lengthwise direction of the developing agent storing portion.

25. The packing method of claim 21, wherein the developing agent container is received in the packing receptacle as the developing agent container is put in a sealing bag.

26. A method of assembling an image forming apparatus, the method comprising:

providing a developing agent container packed using a packing technique;

wherein the packing technique includes;

preparing a packing receptacle including a top end and a bottom end and a plurality of side surfaces extending vertically between the top end and the bottom end to define a plurality of corners; and causing the developing agent container to be received inside the packing receptacle so that the developing agent container containing toner therein, is inclined with respect to all side surfaces extending between the top end and the bottom end of the packing receptacle and a first end of the developing agent container is disposed adjacent a first corner of the packing receptacle and a second end of the developing agent container is disposed adjacent a second corner that is diagonally opposite from the first corner by disposing supporting members along opposing longitudinal sides of the developing agent container, wherein the developing agent container has a longitudinal axis which is inclined with respect to one side surface of the packing receptacle, and wherein the supporting member includes at least one projection and at least one groove corresponding to the at least one projection formed thereon.

27. A packaging unit usable with a developing agent container, the packaging unit comprising:

a packing case including a top end and a bottom end and a plurality of side surfaces extending vertically between the top end and the bottom end to define a plurality of corners; and a developing agent container including first and second ends and storing toner therein and disposed inside the packing case, the developing agent container to be inclined with respect to all side surfaces extending between the top end and the bottom end of the packing case and a first end of the developing agent container is disposed adjacent a first corner of the packing case and a second end of the developing agent container is disposed adjacent a second corner that is diagonally opposite from the first corner by supporting members disposed along opposing longitudinal sides of the developing agent container, wherein the developing agent container has a longitudinal axis which is inclined with respect to one side surface of the packing case, and wherein the supporting members include at least one projection and at least one groove corresponding to the at least one projection formed thereon.

28. The packaging unit of claim 27, wherein an inclined angle is about 45 degrees between longitudinal axis of the developing agent container and one side surface of the packing case.

29. The packaging unit of claim 27, wherein the developing agent container has a dimension of a length and a width shorter than the length, and the length of the developing agent container is inclined with respect to the one side surface of the packing case.

30. The packaging unit of claim 29, wherein the packing case comprises a top side, a bottom, and the side formed between the top side and the bottom, and the length is disposed in a longitudinal direction to have an inclined angle smaller than a right angle with respect to an inclined angle.

31. The packaging unit of claim 27, wherein the packing case comprises a top side, a bottom side, and a plurality of sides formed between the top side and the bottom side, one of the plurality of sides of the packing case forming an angle with the developing agent container.

32. The packaging unit of claim 27, further comprising:

a support member disposed between the packing case and the developing agent container to maintain a position of the developing agent container with respect to the packing case.

33. The packaging unit of claim 32, wherein the support member and the packing case are formed in a single integral body.

34. A method of using a packaging unit having a developing agent container, the method comprising:

storing toner in a developing agent container; and disposing the developing agent container inside a packing case including a top end and a bottom end and a plurality of side surfaces extending vertically between the top end and the bottom end to define a plurality of corners such that the developing agent container containing toner, is inclined with respect to all sides extending between the top end and the bottom end of the packing case and a first end of the developing agent container is disposed adjacent a first corner of the packing case and a second end of the developing agent container is disposed adjacent a second corner that is diagonally opposite from the first corner, by disposing supporting members along opposing longitudinal sides of the developing agent container, the supporting members having at least one projection and at least one groove corresponding to the at least one projection formed thereon, wherein the developing agent container has a longitudinal axis which is inclined with respect to one side surface of the packing case.

35. A developing agent container package unit comprising:

an exterior packing case including a top end and a bottom end and a plurality of side surfaces extending vertically between the top end and the bottom end to define a plurality of corners and integrally formed with an interior supporting member supporting a developing agent container containing toner therein so that the developing agent container is inclined with respect to all side surfaces extending between the top end and the bottom end of the exterior packing case and a first end of the developing agent container is disposed adjacent a first corner of the packing case and a second end of the developing agent container is disposed adjacent a second corner that is diagonally opposite from the first corner, wherein a longitudinal axis of the developing agent container is aligned with a diagonal along a bottom surface of the exterior packing case and the longitudinal axis of the developing container is inclined with respect to one side surface of the packing case, and wherein the interior supporting member is disposed along opposing longitudinal sides of the developing agent container, the interior supporting member having at least one projection and at least one groove corresponding to the at least one projection formed thereon.

* * * * *